United States Patent [19]

Sakurai

[11] Patent Number: 4,637,007

[45] Date of Patent: Jan. 13, 1987

[54] TOY HAVING A MELODY-MAKING MECHANISM OF A SOUND-DETECTION TYPE

[76] Inventor: Koichi Sakurai, 316-77, Oaza-kozenji, Oramachi, Ora-gun, Gunma-ken, Japan

[21] Appl. No.: 712,403

[22] Filed: Mar. 12, 1985

[30] Foreign Application Priority Data

Jul. 20, 1984 [JP] Japan ..... 59-109949[U]

[51] Int. Cl.[4] ..... A63H 3/33; G11B 31/00; G11B 19/00

[52] U.S. Cl. ..... 369/67; 369/19; 369/63; 446/175; 446/297

[58] Field of Search ..... 369/19, 20, 50, 63, 369/67; 340/286 M, 566; 367/198, 199; 446/175 AR

[56] References Cited

U.S. PATENT DOCUMENTS

| | | | |
|---|---|---|---|
| 3,588,118 | 6/1971 | Pipa | 369/63 |
| 4,196,423 | 4/1980 | Carver et al. | 340/566 |
| 4,221,927 | 9/1980 | Dankman et al. | 367/198 |
| 4,302,749 | 11/1981 | Ylonen | 367/198 |
| 4,317,189 | 2/1982 | Fukuoka | 369/50 |
| 4,413,290 | 11/1983 | Furuta | 369/50 |

*Primary Examiner*—Steven L. Stephan
*Attorney, Agent, or Firm*—Young & Thompson

[57] ABSTRACT

A toy, such as a stuffed doll, having a melody-making mechanism of a sound-detection type is disclosed, in which the melody-making mechanism is provided with a sound-detector, an amplifier circuit and a switching circuit in such arrangement that operation of the melody-making mechanism may be discontinued after a predetermined period of time. The sound-detector may be in the form of a ceramic condenser or a microphone.

1 Claim, 6 Drawing Figures

TOY HAVING A MELODY-MAKING MECHANISM OF A SOUND-DETECTION TYPE

FIELD OF THE INVENTION

This invention relates to a toy, such as a stuffed doll, having a melody-making mechanism of a sound-detection type, which may detect sound and thereupon play a melody.

BACKGROUND OF THE INVENTION

Such toys having a melody-making mechanism of the sound-detection type have been devised but have several disadvantages of complicated structure, very high and uneconomical consumption of electricity, normally unstable detection of sound and unreliable operation of the sound-detection.

Accordingly, an object of the invention is to provide a toy having the melody-making mechanism of the sound-detection type, which may solve the problems as described hereinabove, namely having features of simple structure, very low and economical consumption of electricity, stable sound-detection and reliable operation.

SUMMARY OF THE INVENTION

In accordance with the invention, there is provided a toy, such as a stuffed doll, having a melody-making mechanism of a sound-detection type, in which the melody-making mechanism has a switch operable through detection of sound comprising a sound-detecting means, an amplifier circuit for amplifying an electric signal from the sound-detecting means and a switching circuit to be turned on by the sound-detection signal from the amplifier circuit is embedded within a toy body, its operation being discontinued after a predetermined period of time from the starting time when the operation is started by the ON-signal in said switching circuit of said melody-making mechanism.

In the toy according to the invention, the sound-detecting means may comprise a ceramic condenser or a microphone.

The invention will be described hereinbelow in more detail for its preferred embodiments with reference to the accompanying drawings.

PREFERRED EMBODIMENTS OF THE INVENTION

Figure 1:
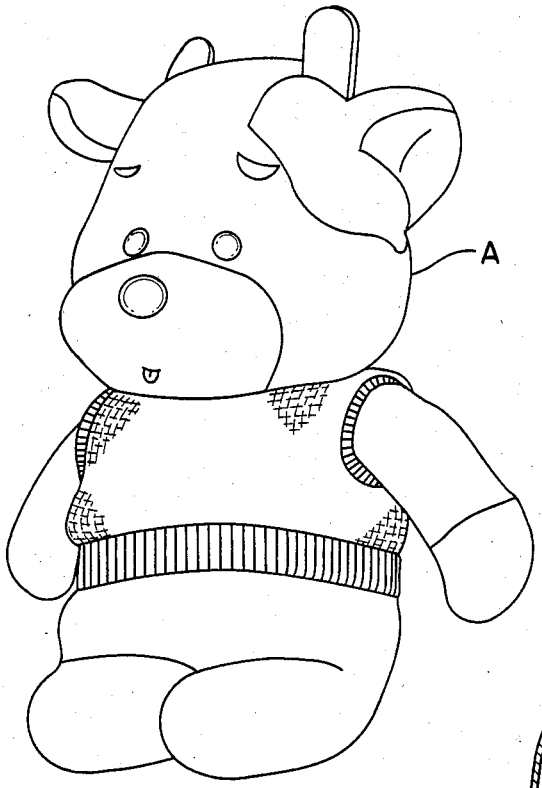
FIG. 1 is a pictorial view of the toy according to the invention.

In FIG. 1, a symbol A represents a toy body, such as a stuffed doll of a baby, an animal (for example cattle, sheep, dog, cat, pig and others) or the like made of cotton, cloth and plastics, which toy body A contains therein a melody-making mechanism C having a switch B operable through detection of sound.

The switch B comprises a sound-detecting means 1 (such as a ceramic condenser of FIG. 2 or a microphone), an amplifier circuit 2 for amplifying an electric signal from the sound-detecting means 1 and a switching circuit 3 for turning on the melody-making mechanism through the sound-detection signal from the amplifier circuit 2.

Figure 3:
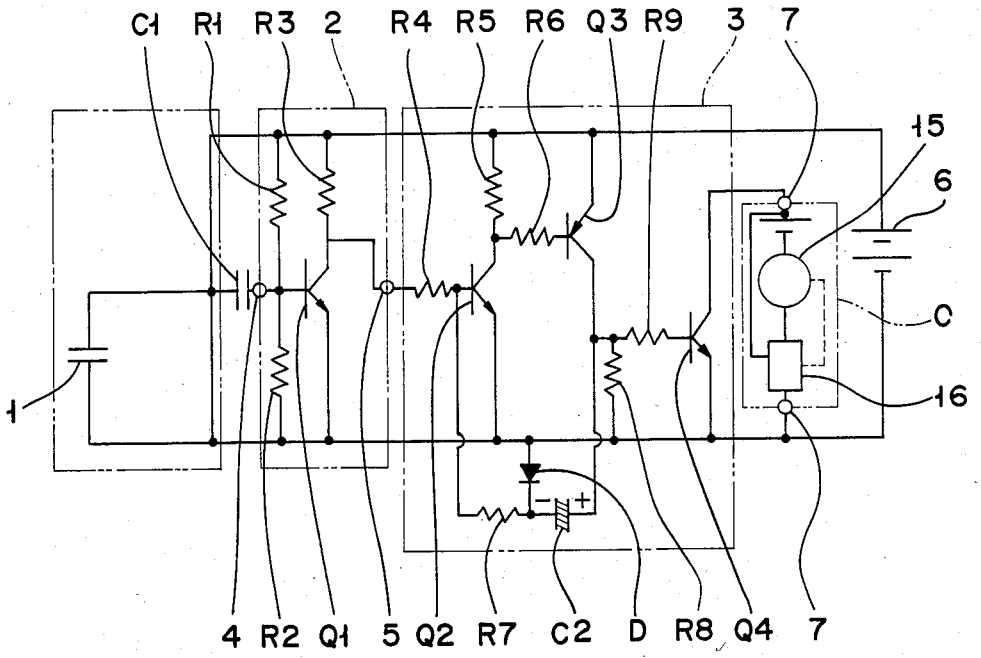
FIG. 3 is a circuit diagram of the melody-making mechanism used in the invention.

As shown in FIG. 3, the amplifier circuit 2 comprises resistors R1, R2 and R3 as well as a transistor Q1 of NPN type, while the switching circuit 3 comprises transistors Q2, Q4 of NPN type, a transistor Q3 of PNP type, resistors R4, R5, R6, R7, R8, R9 and an electrolytic condenser C2 as well as a diode D. The sound-detecting means 1, such as the ceramic condenser or the microphone, is connected through a condenser C1 to an input terminal 4 of the amplifier circuit 2, while its output terminal 5 is connected through the resistor R4 to a base of the transistor Q2 in the switching circuit 3. A collector of the transistor Q2 is connected through the resistor R5 to a (+) terminal of a dry battery 6 as a DC power source, while an emitter of the transistor Q2 is connected to a (−) terminal the dry battery 6. Further, to the collector of the transistor Q2 is connected through the resistor R6 a base of the transistor Q3, an emitter of which transistor Q3 is connected to the (+) terminal of the dry battery 6, while a collector of the transistor Q3 is connected through the resistor R8 to the (−) terminal of the dry battery 6. To the collector of the transistor Q3 is connected a (+) terminal of the electrolytic condenser C2, a (−) terminal of which is connected through the resistor R7 to a base of the transistor Q2. Between the (−) terminals of the electrolytic condenser C2 and the dry battery 6 is arranged the diode D with its anode side being on the battery side. Further, the collector of the transistor Q3 as the switching element is connected through the resistor R9 to a base of the transistor Q4 as a similar switching element.

The (−) terminal of the dry battery 6 is connected to an emitter of the transistor Q4 with its collector and emitter being an output terminal 7 of the switching circuit 3.

Thus, when external sound, such as hand clapping or human voice, is supplied to the toy, the sound-detecting means 1 may detect the external sound while the amplifier circuit 2 may amplify the electric signal from the sound-detecting means 1. The amplified signal may turn the transistor Q2 on. The transistor Q2 in its ON state permits a base current of the transistor Q3 to flow thereby turning the transistor Q3 on. Then, a collector current of the transistor Q3 flows through a base of the transistor Q4 thereby to turn the latter on and thus to actuate the melody-making mechanism C as described hereinafter.

Simultaneously with operation of the melody-making mechanism C, the collector current of the transistor Q3 may flow through the CR circuit of the resistor R7 and the electrolytic condenser C2 to the base of the transistor Q2 until the condenser C2 is electrically charged, and thus the transistor Q2 may continue its ON state even after the external sound or its amplified signal is discontinued. Consequently, the transistors Q3, Q4 maintain their ON state to continue rotation of a motor as described hereinafter. Upon completion of charging the condenser C2, the base current of the transistor Q2 stops flowing thereby to turn the latter off. The transition of the transistor Q2 to its OFF state makes the other transistors Q3, Q4 turn also to the OFF state, thereby to discontinue the starting signal for the melody-making mechanism C.

Figure 6:
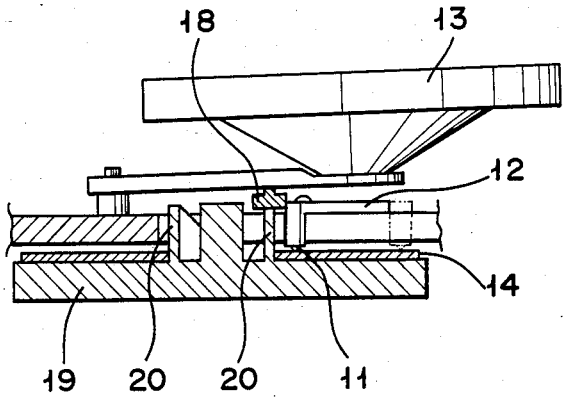
FIG. 6 is a front view of the melody-making mechanism of FIG. 5 but in a position immediately before the end of the operation.
Figure 4:
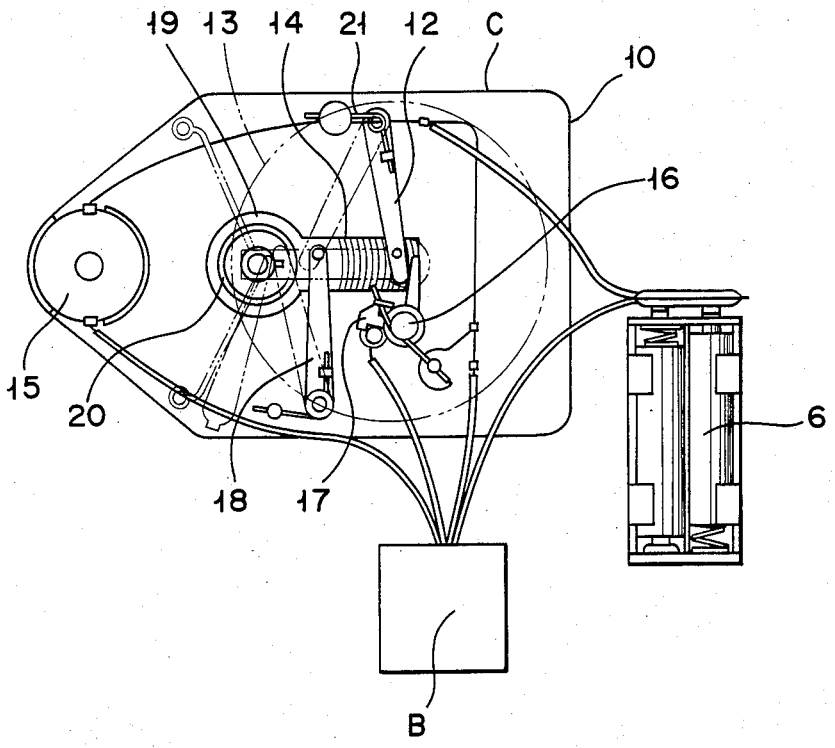
FIG. 4 is a plan view of the melody-making mechanism with parts broken away.
Figure 5:
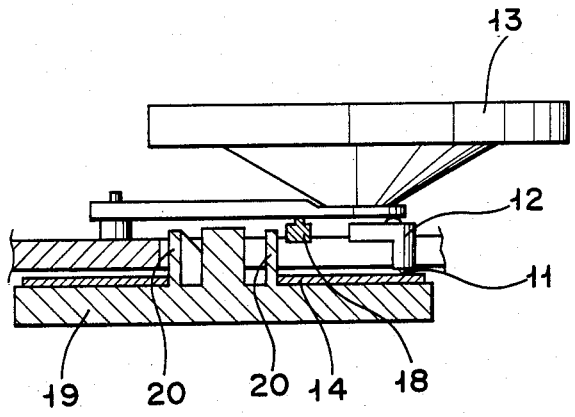
FIG. 5 is a front view of the melody-making mechanism in a position before the start of operation.

The melody-making mechanism C may be of any type, such as a music box operated by a motor, an electronic music box using a melody IC, a small record player 10 as shown in FIGS. 4 to 6 and the like. The record player 10 may comprise an arm 12 having a needle 11, a speaker 13 associated with the needle 11 and a motor controlling means 16 for maintaining rotation of a motor 15 while playing a disk 14 and for automatically discontinuing the rotation of the motor 15 at the end of the playing.

The motor controlling means 16 may control the rotation of the motor 15 and has a motor switch 17 associated with the arm 12. Namely, the motor switch 17 is opened by the arm 12 in its position before playing the disk and then the arm 12 is moved by rotation of the motor 15 started by other signals for moving the needle 11 toward the center of the disk 14, which movement of arm 12 may open the motor switch 17. Thereafter, even after the starting signals have been discontinued, the motor 15 may continue its rotation due to the motor switch 17. At the end of the playing, the arm 12 may urge a return arm 18 which in turn contacts a cam 20 formed above the disk 14 for moving the return arm 18 upwardly. This upward movement allows the arm 12 to be released from being urged toward the disk 14 by the speaker 13 and thus to return to its initial position by means of a coil spring 21. The returning movement of the arm 12 may open the motor switch 17 to discontinue the rotation of the motor 15. Thus, the record player 10 serving as the melody-making mechanism C may receive the starting signal from the switch B to start playing the disk 14 and return the arm 12 to its initial position after ending the disk-playing.

Figure 2:
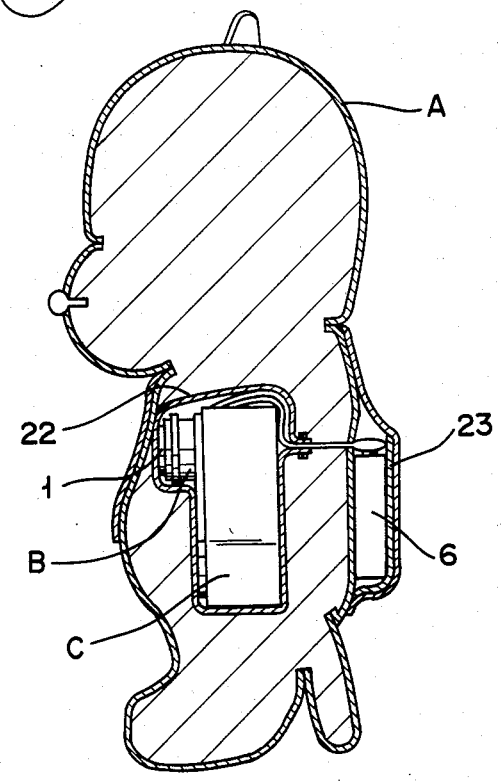
FIG. 2 is a vertical section of the toy as shown in FIG. 1.

In FIG. 2, a reference numeral 22 represents a cloth bag for accommodating melody-making mechanism C with the switch B operable through the sound-detection, while a reference numeral 23 represents a bag portion for receiving the dry battery 6.

In accordance with the invention, the melody-making mechanism C with the switch B operable through the sound-detection comprising the sound-detecting means 1 (such as the ceramic condenser or the microphone), the amplifier circuit 2 and the switching circuit 3 is embedded in the toy body A and its operation may be discontinued after a predetermined period of time from the starting time when the operation is started by the ON-signal in the switching circuit 3 of the melody-making mechanism C. The toy having the melody-making mechanism thus constructed has the advantages of a simple structure as well as a low and economical consumption of electricity because only very little electric current may flow through the resistors R1, R2 of the amplifier circuit 2 except when the sound-detecting means 1 is operating.

Furthermore, the low electric consumption may reduce the load on dry battery 6, so that a power switch may be omitted thereby to provide stable and reliable sound-detection.

Although the invention has been described hereinabove as to preferred embodiments, it will be appreciated that many modifications may be made without departing from the scope of the invention. For example, in lieu of the cow as the toy body A shown in FIG. 1, any other animals may be simulated such as a sheep, a dog, a cat, a pig and a human baby, using a disk 14 of the melody-making mechanism C with their characteristic crying sounds.

What is claimed is:

1. A doll toy of the type wherein, upon detection of a sound, a melody will be played, said doll toy having a body containing: a sound detecting means, said means generating an electric signal upon detection of sound; an amplifying means comprising a transistor amplifier circuit for amplifying said electric signal from said sound detecting means; a switching circuit to which said amplified signal is applied to create a voltage between outputs of said switching circuit; a melody-making mechanism having a turntable disc player driven by a small electric motor on which a small sound disc is placed, a needle-supporting arm pivoted at its one end, a spring which returns the arm to an original position after the disc is played, and a motor switch associated with said switching circuit for activating said electric motor, said motor switch being opened by return movement of said supporting arm, wherein said melody-making mechanism is electrically connected to the output terminals of the switching circuit, said switching circuit further comprising six resistors R4, R5, R6, R7, R8 and R9 respectively, and three transistors Q2, Q3 and Q4 respectively, a diode D and a capacitor C2, wherein one side of resistor R4 receives said amplified signal and the other side of resistor R4 is connected to both the base of transistor Q2 and one side of resistor R7, the emitter of transistor Q2 being connected to the negative terminal of a dry cell battery, the collector of transistor Q2 being connected to one side of both resistor R5 and R6, the other side of resistor R5 being connected to the positive terminal of the dry cell battery and the other side of resistor R6 being connected to the base of transistor Q3, the emitter of transistor Q3 being connected to the positive terminal of the dry cell battery, the collector of transistor Q3 being connected to one side of resistor R8, one side of resistor R9 and the positive side of capacitor C2, the negative side of capacitor C2 being connected to the other side of resistor R7, the diode being connected in a forward direction between the negative terminal of the dry cell battery and a contact between resistor R7 and the negative side of capacitor C2, the other side of resistor R8 being connected to the negative terminal, the other side of resistor R9 being connected to the base of transistor Q4, the emitter of transistor Q4 being connected to the negative terminal, the collector of transistor Q4 being connected to the input of said melody-making mechanism such that the emitter and the collector of transistor Q4 comprise said outputs of said switching circuit and said resistor R7 and said capacitor C2 comprise a resistance-capacitor circuit; such that, in operation said sound-detecting means, upon detection of a sound operates through said amplifier circuit and said switching circuit to actuate said melody-making mechanism until said capacitor is charged, whereupon said switching circuit no longer actuates said melody-making mechanism, said melody-making mechanism continuing to operate until the end of said disc is reached; said dry cell battery providing power for operation of said amplifier circuit, detecting means, switching circuit and melody-making mechanism.

* * * * *